United States Patent [19]

Schober

[11] 4,164,454

[45] Aug. 14, 1979

[54] CONTINUOUS LINE FOR PLATING ON METAL STRIP MATERIAL

[75] Inventor: Michael A. Schober, Stuttgart, Fed. Rep. of Germany

[73] Assignee: Borg-Warner Corporation, Chicago, Ill.

[21] Appl. No.: 847,636

[22] Filed: Nov. 1, 1977

[51] Int. Cl.[2] ..... C25D 7/06

[52] U.S. Cl. ..... 204/28; 204/207; 204/237

[58] Field of Search ..... 204/28, 206–211, 204/237–239; 118/67

[56] References Cited

U.S. PATENT DOCUMENTS

| | | | |
|---|---|---|---|
| 2,274,963 | 3/1942 | Hopper | 204/210 |
| 2,382,018 | 8/1945 | Martin | 204/206 |
| 2,490,055 | 12/1949 | Hoff | 204/206 |
| 2,576,074 | 11/1951 | Nachtman | 204/28 |
| 3,007,854 | 11/1961 | Smith et al. | 204/207 |
| 3,730,667 | 5/1973 | Tani et al. | 118/67 |
| 3,796,643 | 3/1974 | Swalheim | 204/206 |
| 3,864,235 | 2/1975 | Bobrov et al. | 204/206 |

*Primary Examiner*—John H. Mack
*Assistant Examiner*—William Leader
*Attorney, Agent, or Firm*—James A. Geppert

[57] ABSTRACT

A continuous line for plating on indeterminant lengths of metallic strip material where space is limited by providing a line of modular construction and upwardly sloping through the plating operation. The modular line includes feeding of the metallic strip from an overhead coil, solution tanks disposed on an upwardly inclined path for the cleaning, etching, deoxidizing and rinsing of the strip surfaces, plating tanks for the continuous electrodeposition of metal onto both surfaces of the strip, rinsing tanks and driers and then winding the plated strip onto a second coil.

17 Claims, 11 Drawing Figures

CONTINUOUS LINE FOR PLATING ON METAL STRIP MATERIAL

BACKGROUND AND SUMMARY OF THE INVENTION

The present invention relates to the plating of metallic strips which may be utilized in a subsequent operation, and more specifically to the plating of aluminum or aluminum alloy strip with nickel, cobalt, nickel-lead or cobalt-lead for a subsequent fluxless brazing operation.

When a coil of strip material of indeterminant length requires treatment thereof to form a final product or as a preliminary stage to a further processing operation, the various stages of treatment may require a large amount of space if the treatment line for the strip retains a horizontal orientation of the strip. As various tanks are required for preliminary steps as well as the actual treatment stage or stages, space will become an important factor in plant design. If space is limited, then the treatment line must be altered to the space available which may result in a less efficient and effective operation. The present invention is utilized to minimize the space requirements of the treatment operation as well as provide certain advantages not found in prior treatment facilities.

The present invention is particularly adapted to a process of plating aluminum strip with nickel, cobalt, nickel-lead or cobalt-lead in preparation for a fluxless aluminum brazing operation as disclosed in U.S. Pat. Nos. 3,482,305 and 3,970,237, wherein aluminum or aluminum alloy parts are brazed together using an aluminum-silicon brazing alloy.

The present invention comprehends the provision of a continuous plating line for a metallic strip of indeterminant length wherein the plating line has a modular design. The modules include (1) the feeding of the metal strip from a coil, (2) preliminary or pretreatment steps for preparation of the strip for plating, (3) continuous electrodeposition of plating material onto the strip, (4) rinsing and drying of the plated strip, and (5) winding of the plated strip onto a second coil.

The present invention also comprehends the provision of a continuous plating line wherein individual spray tanks are utilized for the pretreatment and post treatment stages of plating with an upwardly inclined or sloping orientation of the spray tanks in the pretreatment and post treatment stages. The use of the sloping arrangement of tanks allows the minimization of drag-out of individual solutions or baths and insures a minimum distance between the spray tanks and the plating tanks to avoid reoxidation of the strip surface without the necessity of additional protective devices, such as moisture chambers, fog sprayers, etc.

The present invention further comprehends the provision of a continuous plating line wherein the plating tanks have a novel solution agitation/circulation system. This system provides for recirculation and filtration of the plating solution or bath used in the electrodeposition operation of the plating material and for the directed discharge of the filtered solution behind the anode in the tank through a tubular anode support frame. The direction and distribution of flow of the plating solution permits control of the uniformity and deposition rate of the plating material, thus counteracting the electrical edge effects without the need for specifically shaped anode configurations to suit varying strip width and thickness.

Another object of the present invention is the provision of a continuous plating line which will improve the uniformity of the plating on the moving strip as well as improving the plating efficiency by 40 to 50%.

Further objects of the present invention are to provide a construction of maximum simplicity, efficiency, economy and ease of assembly and operation, and such further objects, advantages and capabilities as will later more fully appear and are inherently possessed thereby.

DESCRIPTION OF THE PREFERRED EMBODIMENT

Figure 1:
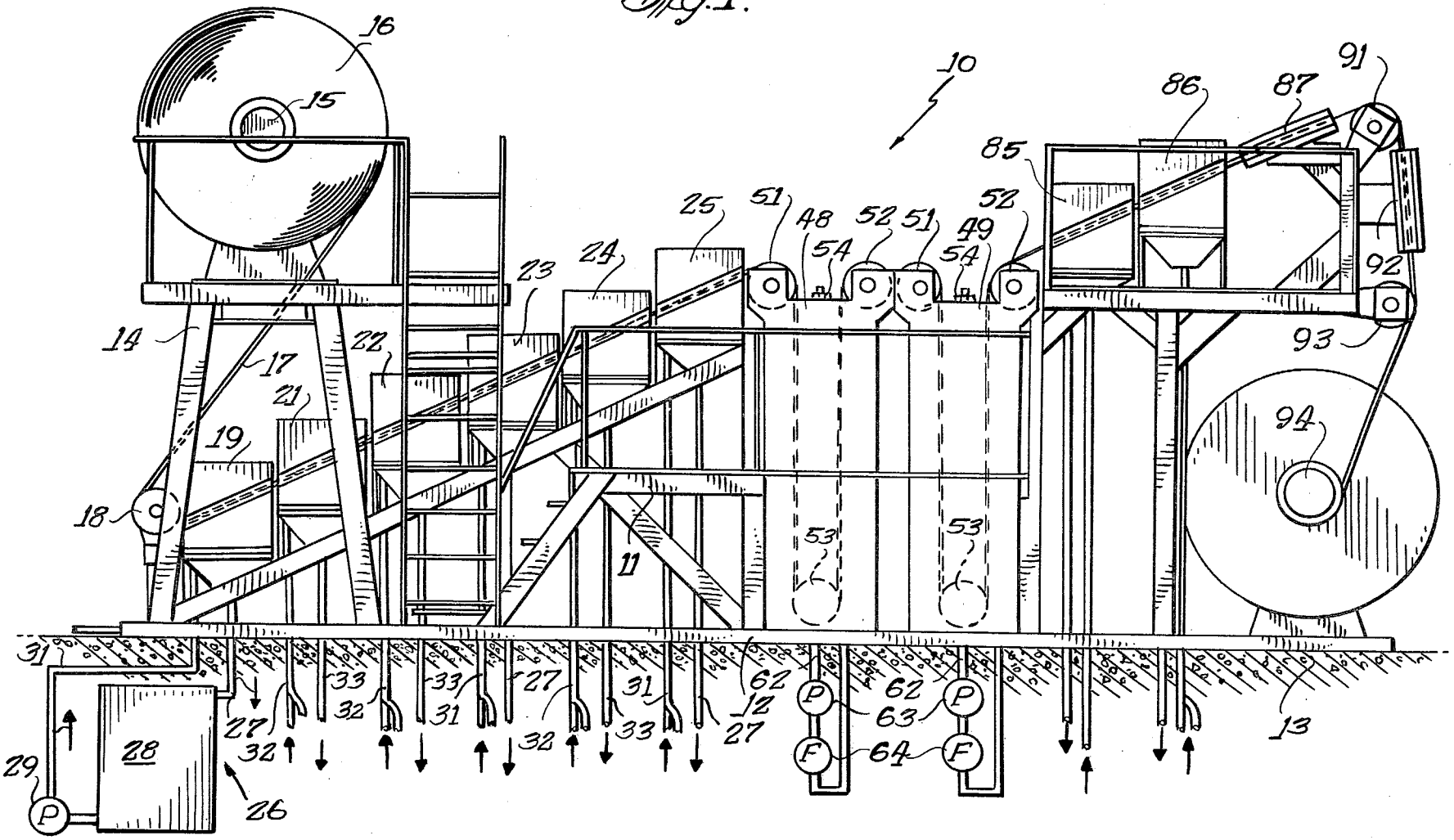
FIG. 1 is a side elevational view of the complete continuous plating line of the present invention.
Figure 2:
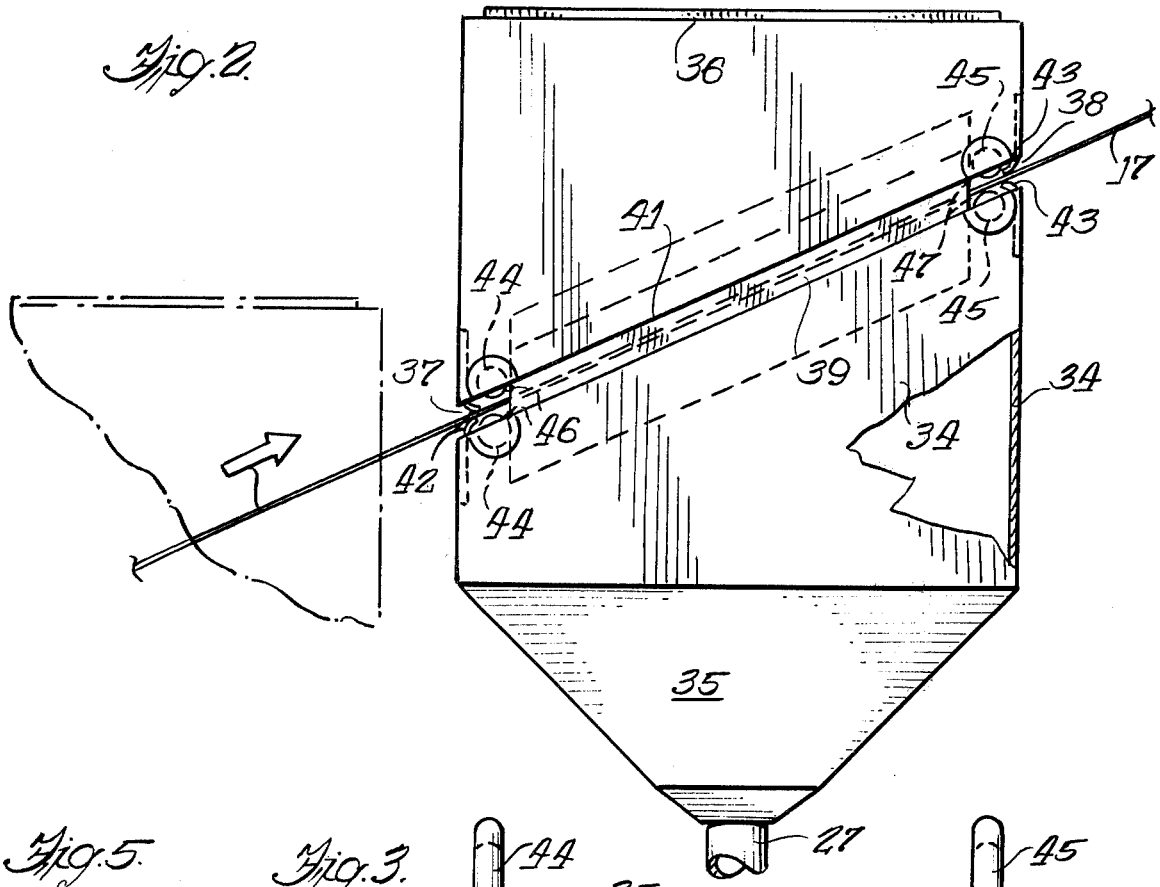
FIG. 2 is an enlarged side elevational view of one of the spray tanks on the sloping portion of the line.
Figure 5:
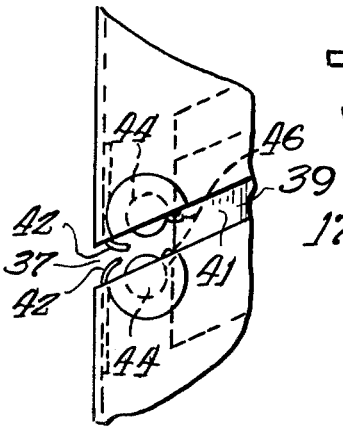
FIG. 5 is an enlarged partial side elevational view of the entrance slot for the tank.
Figure 3:
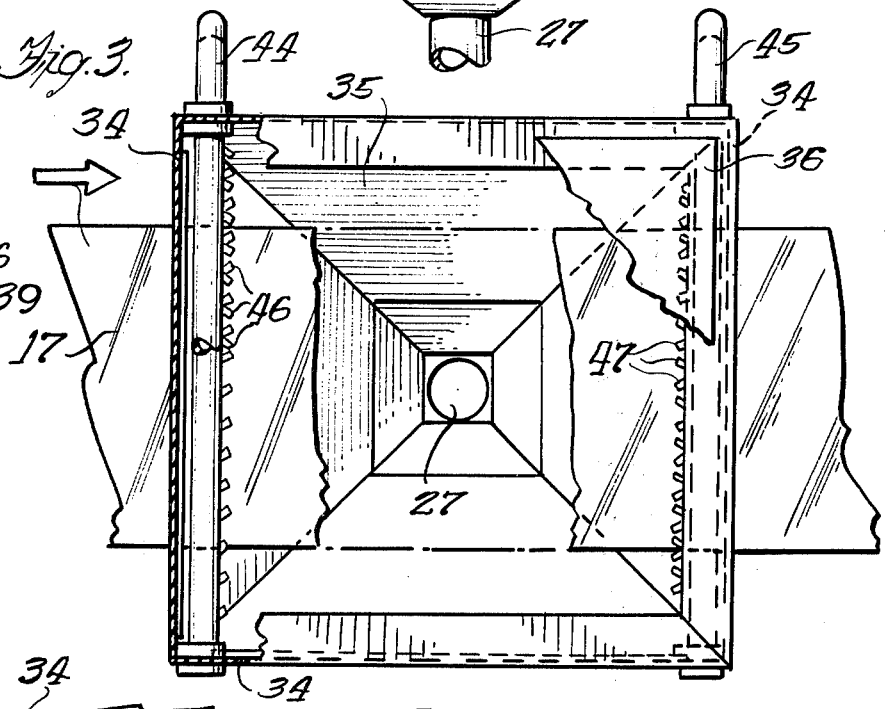
FIG. 3 is a top plan view of the tank of FIG. 2.
Figure 4:
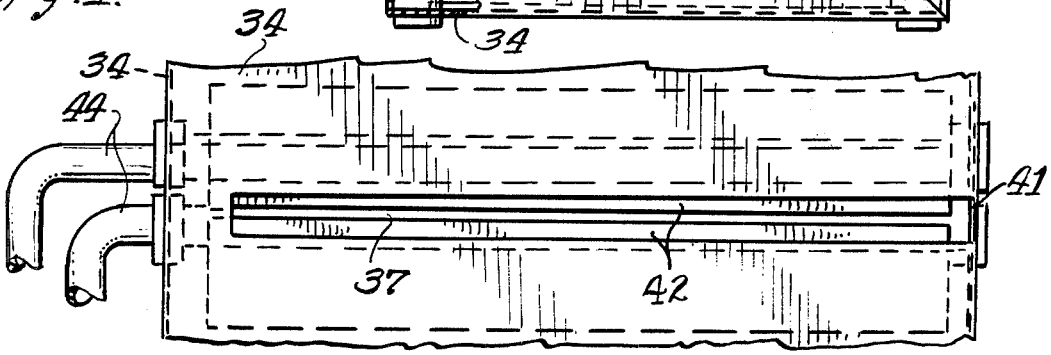
FIG. 4 is a partial end elevational view of the tank showing the entrance slot.
Figure 11:
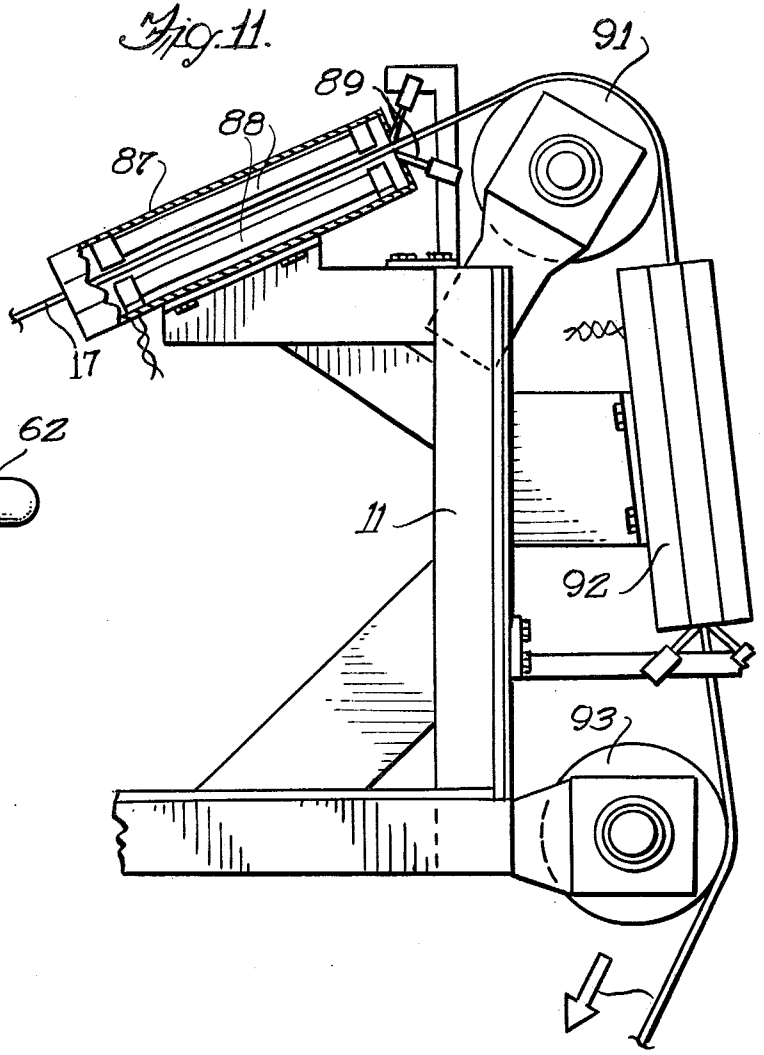
FIG. 11 is an enlarged partial side elevational view of the drying portion of the plating line.
Figure 6:
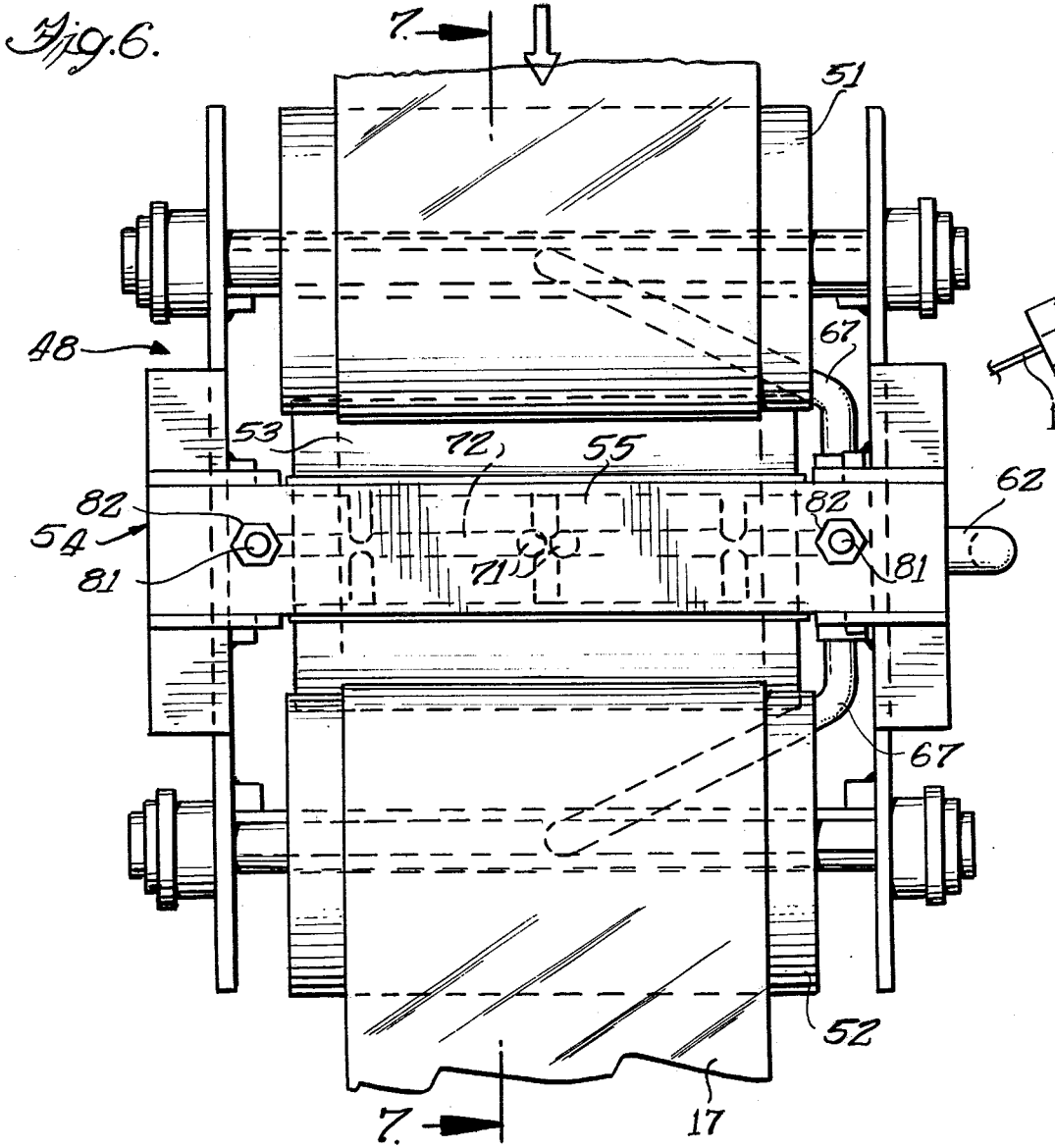
FIG. 6 is a top plan view of one of the plating tanks in the line.
Figures 7, 8, 9:
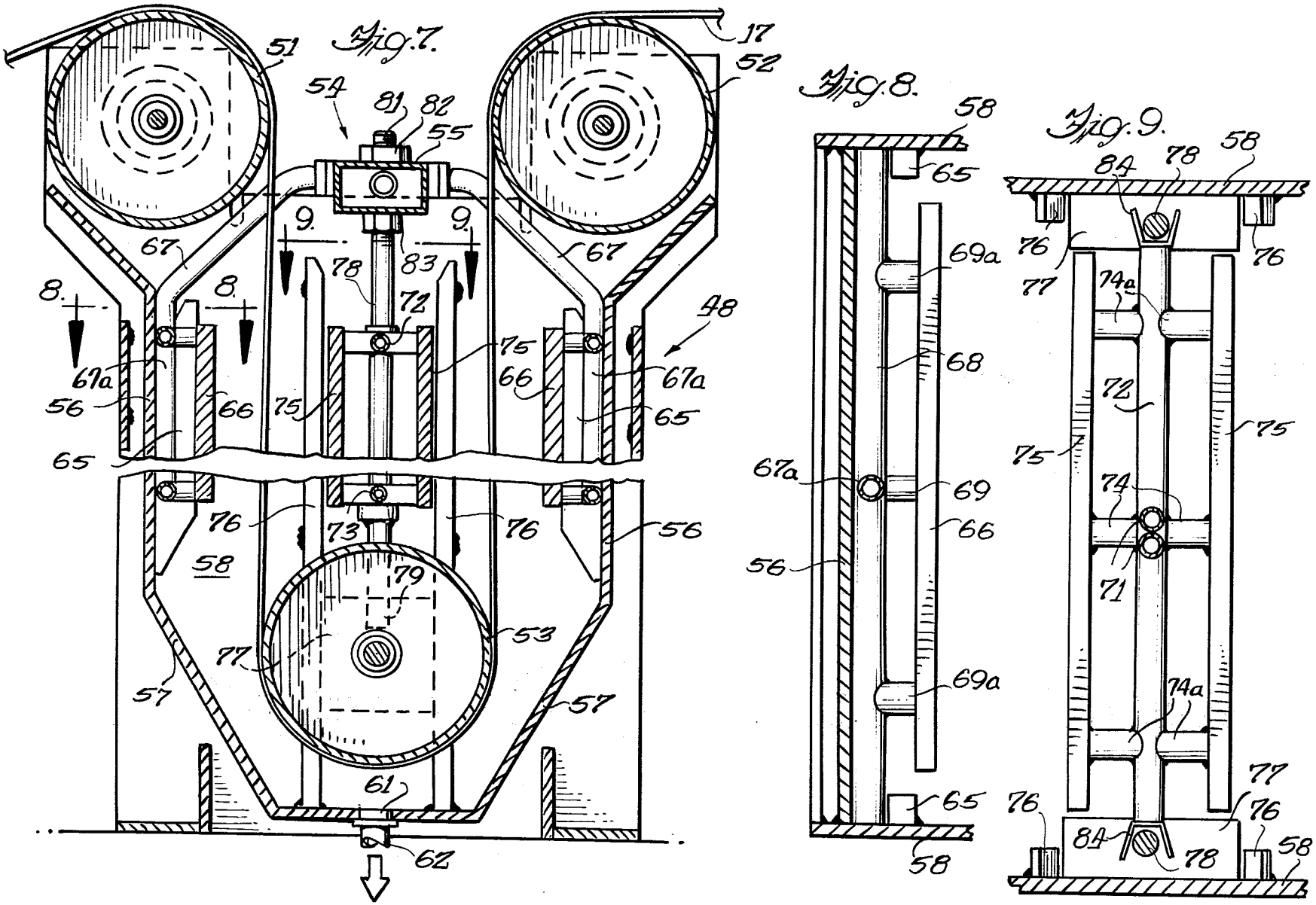
FIG. 7 is a vertical cross sectional view taken on the line 7—7 of FIG. 6.
FIG. 8 is horizontal cross sectional view taken on the line 8—8 of FIG. 7.
FIG. 9 is a horizontal cross sectional view taken on the line 9—9 of FIG. 7.
Figure 10:
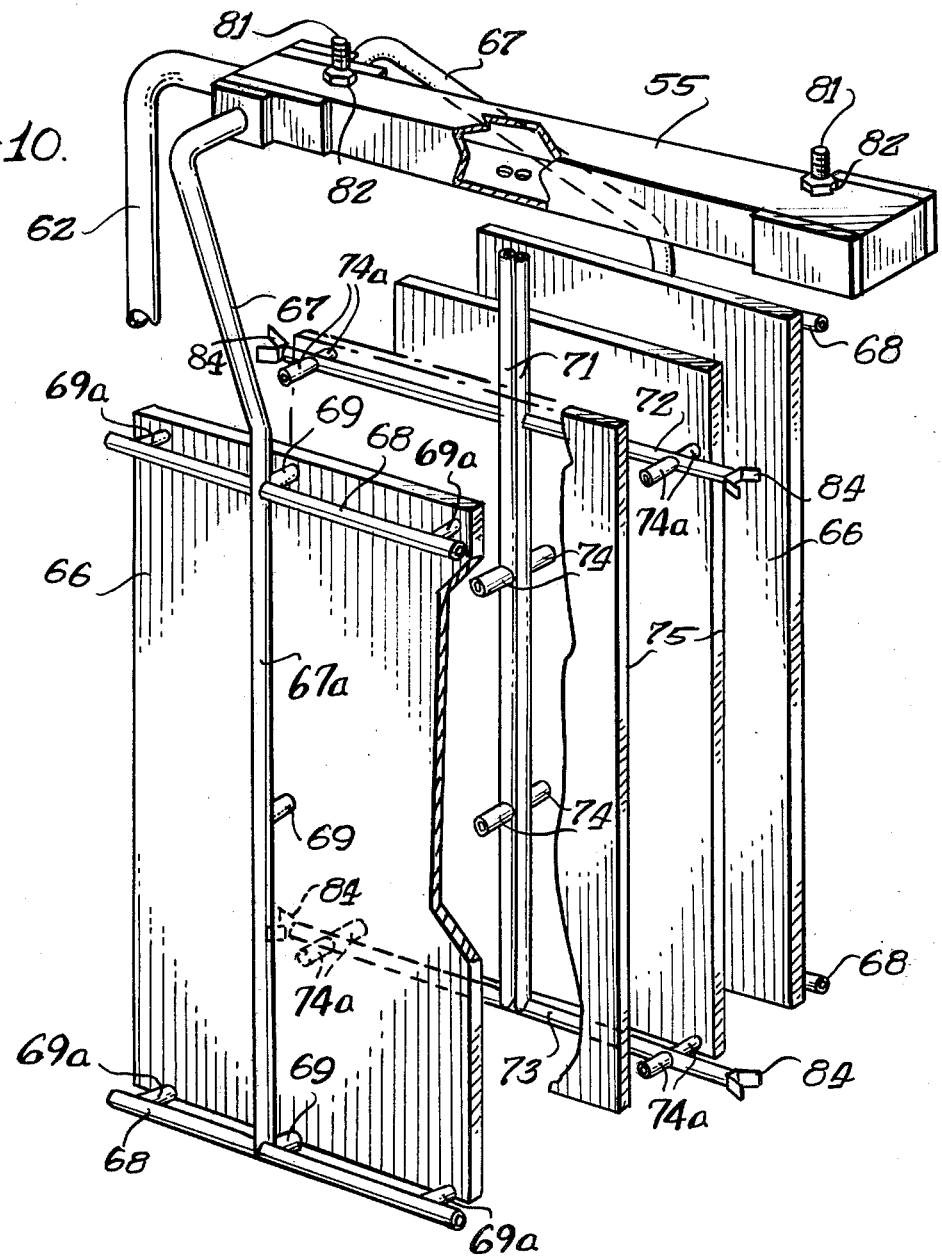
FIG. 10 is an enlarged perspective view of the anodes and manifold for the plating solution in a plating tank.

Referring more particularly to the disclosure in the drawings wherein is shown an illustrative embodiment of the present invention, FIG. 1 discloses a continuous plating line assembly 10 formed into five modules which include (1) a coil feeding of strip metal, (2) a sloping arrangement of pretreatment bath spray tanks, (3) a pair of plating bath tanks, (4) rinsing tanks and drying stations, and (5) a take-up reel for the coil of plated strip. The entire assembly is suitably mounted in a framework 11 on a base 12 resting on a concrete floor 13 or other suitable support for the weight of the assembly.

The first module includes a vertically oriented frame portion 14 supporting an overhead pay-out reel 15 for a coil 16 of strip metal, such as aluminum, to be plated. The aluminum strip 17 is fed from the coil 16 downwardly and to the left as viewed in FIG. 1 to move around a roller 18 at the left end of the framework 11, the strip then being directed in an upwardly sloping direction into and through a series of preplating cleaning and conditioning stations. These include a series of six tanks 19, 21, 22, 23, 24 and 25 which are arranged on a slope of approximately 25° to minimize drag-out of solution from each individual tank and to insure minimum distance between each tank and finally the plating tanks. Tank 19 contains a caustic cleaning and etching bath, tank 23 contains a deoxidizing and desmutting bath, and tank 25 provides a deionized water rinse. The remaining three tanks 21, 22 and 24 are all rinsing spray tanks connected to a conventional public water system providing up to 400 gallons per hour water flow at regular tap water pressure. The tanks 19, 23 and 25 each have a closed loop circulating system such as shown for tank 19 in FIG. 1. The circulating system 26 is equipped with an effluent line 27, a storage tank 28, a pump 29 and one or more filters (not shown) leading to an influent line 31. The rinse tanks each have an inlet line 32 and an outlet line 33.

Each of the six tanks, as seen in FIGS. 2 through 5 is equipped with a generally square tank portion having side walls 34 with an open top and a funnel-shaped lower end 35 for collection and feeding of the solution or effluent to the line 27 or 33. A cover 36 is provided for the open top of each tank. In two opposite side walls are provided an inlet slit 37 and an outlet slit 38 for movement of the metal strip 17 therethrough. A slit 39 is formed in a third side connecting the slits 37 and 38 and is closed by a soft rubber flap 41 to allow feeding of the strip into the tank from the front. A pair of soft rubber flaps 42, 42 and 43, 43 are provided at the inlet slit 37 and outlet slit 38, respectively, which function as wipers to remove excess solution from both surfaces of the strip. A pair of pipes 44, 45 are positioned within each tank above and below each slit; each pipe being provided with a plurality of spray nozzles 46 or 47 to spray the solution or rinse water uniformly onto both surfaces of the strip moving therebetween. The pipes are all connected to the influent line 31 or the inlet water line 32.

The third module comprises a pair of identical plating tanks 48 and 49 which are elongated vertical tanks having a generally horizontal orientation with respect to the framework 11. Each tank includes a pair of spaced guide rollers 51, 52 at the top of the tank and a submerged roller 53 adjacent the bottom of the tank. The roller 53 is supported from a bridge 54 at the top of the tank which can be lifted by appropriate hoisting equipment (not shown) to facilitate threading of the strip 17. In addition, the bridge and its support structure provides a manifold 55 for recirculating plating solution or bath and electricity (anode) and carries the center anode, respectively. The upper guide rollers 51 and 52 through a graphite brush system connect the strip electrically to provide the cathode for the electrodeposition operation.

With reference to FIGS. 7 through 10, each tank has side walls 56, 56 and end walls 58, 58, the lower portions 57, 57 of the side walls being inwardly inclined to funnel fluid to a drain fitting 61 connected to a conduit 62 for recirculation of the plating bath to the manifold 55. A pump 63 and a filter 64, as well as heat exchangers or heating elements, is provided along the conduit 62. Each side wall has L-shaped mounting brackets 65 to position an outer anode bag or basket 66, preferably formed of titanium and holding pellets of the metals to be plated, as well as masks to control plating uniformly, if required. Branch conduits 67, 67 from the manifold 55 lead to vertical portions **67*a* having spaced stub conduits 69 to feed solution to the anode baskets 66, 66 positioned adjacent the side walls 56. Also, central conduits 71 are connected to the manifold 55 and extend downward to a plurality of stub conduits 74 spaced therealong to feed solution to central anode baskets 75, 75 having the same design and functional characteristics as anode baskets 66. The cross conduits 68, 72 and 73 have stubs 69*a* and 74*a*, respectively, to accurately position the anode baskets. The central feed of the plating solution from the conduits 67 and 71 through the stub conduits 69 and 74** to the anode baskets overcomes electrical edge effects and increases the concentration of the solution and the current density at the center of the moving strip, with a depletion of the solution and lower current density towards the edges of the strip.

The end walls 58, 58 are provided with parallel vertical supports or guides 76, 76 to vertically align and support moveable bearing blocks 77, 77 for the roller 53. A pair of guide rods 78, 78 have threaded opposite ends 79, 81 with one end 79 threadedly engaging a bearing block 77 and the opposite end 81 extending through the manifold 55 to receive nuts 82, 83 above and below the manifold to lock the rod thereon. The cross conduits 72 and 73 are each provided at their outer ends with a generally U-shaped locating flange 84 thereon which receives the guide rod 78 therein to accurately align the conduits and the anode baskets 75.

Subsequent to the plating tanks 48, 49 in the third module, a fourth module provides a postplating rinse and drying station. This module includes a pair of rinse tanks 85 and 86 that are arranged on a slope of approximately 25° to minimize solution drag-out. Each tank 85 and 86 has the same general configuration as the tanks 19 through 25 previously described. The tanks 85 is connected to a public water system for rinse water, while the tank 86 has a closed circulation system for deionized water as the final rinse bath for the plated strip.

A first heating station 87 having infrared heating elements 88 and air knifes 89 at the discharge end is provided on the same slope as the tanks 85, 86 following the tanks. A roller 91 supports and directs the strip to a downwardly inclined second heating station 92. Roller 93 then directs the dried strip to a take-up reel 94 positioned adjacent the base 12 for the supporting framework 11.

Now considering operation of the plating apparatus, this system is especially adapted for the plating of nickel on aluminum strip by electrodeposition in a continuous operation at an optimum speed of 20 feet per minute. A coil 16 of aluminum strip is positioned on the pay-out reel 15 with the strip 17 being fed downwardly around the roller 18 to pass through the tanks 19 through 25 where the strip is cleaned and etched, rinsed, deoxidized and desmutted in suitable baths, rinsed with water obtainable from a public water supply and then rinsed with deionized water. The strip is easily fed through the tanks 19 through 25 by insertion through the front slit 39 in each tank.

The strip is then fed over the roller 51, around the submerged roller 53 and over the roller 52 in tank 48, and similarly around the rollers in tank 49. The plating solution or bath for each tank is pumped via the conduit 62 by a pump 63 through a filter 64 to the manifold 55, from which fluid is distributed through the anode baskets 66 and 75 for distribution around the strip 17 as it passes through each tank. The plating solution or bath can be circulated at a volume of up to 400 gallons per minute under 20 psi pressure. Heating elements or heat exchangers are utilized along the conduit 62 to provide operating temperatures of up to 160° F. The anode baskets 66, 75 provide the anode and the rollers 51, 52 contacting the strip provide the cathode for the electrodeposition of nickel onto the strip.

After passing through the tanks 48 and 49, the plated strip is rinsed in the tanks 85 and 86 and dried by passing through the heaters 87 and 92 and then wound on the take-up reel 94 which provides an adjustable constant tension of up to 480 pounds. Obviously control systems may have to be utilized to control the pH of the preplating and plating solutions and to provide an override for the constant tension control of the take-up reel.

The present invention also relates to a novel process for continuous electroplating or electrodeposition of a metal or alloy onto a metallic strip wherein the process includes the steps of feeding the metallic strip from a coil to and through a series of preplating baths, including cleaning and etching, deoxidizing, desmutting and rinsing baths, moving the strip through one or more plating baths where the strip passes over rollers and between several spaced anodes positioned in the plating bath, the strip becoming the cathode for the electrodeposition operation, the passing the strip through one or more rinsing tanks, drying the strip in one or more heating stations, and coiling the strip on a take-up reel.

The process further comprehends a novel recirculation cycle for the solution of the plating baths where the plating solution is withdrawn from the bottom of each tank and pumped through a filter and returned to the tank through a distribution manifold and a conduit framework so that the plating solution is directed through the anode toward the moving strip; each anode being formed as a metallic wire basket holding pellets of the metals or alloys to be plated to allow for flow of solution therethrough. Also, the pretreatment bath tanks and the postplating rinse tanks are all arranged on an upward slope to minimize the distance between the tanks, reduce drag-out of individual solutions, and maintain the strip wet to avoid reoxidation of the pretreated strip.

I claim:

1. A process for the continuous electroplating of a metallic strip comprising the steps of feeding a strip on a continuous upward incline through a series of plating preparation baths contained in a series of tanks arranged on an upward incline substantially the same as the moving strip, each of said tanks having an entrance slit in one wall and an exit slit in the opposite wall but positioned higher than the entrance slit to provide said incline for the strip passing therethrough, moving the strip through one or more plating baths, rinsing the plated strip and drying the strip, wherein the strip is passed over rollers in the plating bath and between spaced anodes therein, causing the strip to become the cathode, and pumping plating solution through the anodes toward the center of the moving strip.

2. A process as set forth in claim 1, wherein each anode is in the form of a porous basket to allow flow of plating solution therethrough.

3. A process as set foth in claim 2, including the steps of pumping the plating solution from the plating bath through a filtering and heating system and returning it through vertical conduits of a tubular anode support frame to direct the fluid centrally toward and distribute the solution through the anode baskets to increase the concentration of the solution and the current density at the center of the moving strip.

4. A process as set forth in claim 1, in which the upward slope of said preplating tanks reduces the distance between tanks, maintains the treated strip wet, avoids reoxidation of the strip surfaces and reduces drag-out of individual solutions.

5. An apparatus for the continuous electroplating of a metallic strip including at least one electroplating tank having rollers directing the strip through the tank and plating solution, means to connect the strip electrically to provide a cathode for the electrodeposition operation, a plurality of anodes in the form of wire baskets holding pellets of the metals to be plated spaced in the tank for passage of the moving strip therebetween, and means for recirculation of the plating solution from the tank to a recirculation manifold distributing the solution through said anodes toward said moving strip, said recirculation manifold being located adjacent the top of the tank, and a framework of tubing from the manifold to the anodes, said tubing including vertically oriented tubes extending downward behind the centers of the anodes and having stubs to discharge solution through the anodes towards the center of the moving strip.

6. Apparatus as set forth in claim 5, in which said rollers include a pair of spaced guide rollers at the upper end of the tank and a centrally located submerged roller to guide the moving strip in a generally U-shaped path through the tank, said wire baskets comprising anode baskets adjacent a pair of opposed walls of the tank and a pair of centrally located anode baskets generally opposite the first mentioned baskets, said strip passing between the opposed pairs of anode baskets as it moves through the tank, said vertically oriented tubes including a tube behind the center of each side anode basket and a pair of central tubes depending from said manifold between the central anode baskets.

7. Apparatus as set forth in claim 6, including a pair of bearing blocks supporting the submerged roller, parallel guide members in said tank for vertically guiding said bearing blocks, and a pair of guide rods extending between and secured to said bearing blocks and said manifold, at least one of said central depending tubes being provided with transverse support tubes, and a locating flange on the opposite ends of each support tube receiving said guide rods therein.

8. Apparatus as set forth in claim 6, including a pair of generally L-shaped locating guides adjacent said pair of opposed tank walls to receive said tubing and anode baskets adjacent said side walls, and a pair of transverse support tubes secured to each side tube and supported and retained by the L-shaped guides.

9. Apparatus for the continuous electroplating of a metallic strip, comprising a series of modules defining the stages of the plating line, said modules including a supply reel for the metallic strip, a plurality of preplating treatment tanks arranged in an upwardly sloping design, one or more plating tanks, a plurality of postplating rinsing tanks arranged in an upwardly sloping design, one or more heating stations to dry the plated strip, and a take-up reel providing tension on the metallic strip, said metallic strip passing through said preplating and postplating tanks in a continuous upward slope of substantially the same angle as the slope of the tanks, each of said preplating and postplating tanks being vertically oriented and having an entrance slit in one wall and an exit slit in the opposite wall but positioned higher than the entrance slit to provide the sloping arrangement for the strip passing therethrough.

10. Apparatus as set forth in claim 9, including upper and lower flexible wiping flaps within each preplating and postplating tank adjacent the entrance and exit slits.

11. Apparatus as set forth in claim 9, including upper and lower solution feeding pipes within each preplating and postplating tank adjacent the entrance and exit slite, and a plurality of spray nozzles on each pipe to direct solution to both the upper and under surfaces of the moving strip.

12. Apparatus as set forth in claim 9, in which a wall of each tank has an inclined slit closed by a flexible cover, said slit extending between the entrance and exit slits to allow for insertion of the strip in the inclined position in the tank.

13. Apparatus as set forth in claim 9, in which said plating tanks are vertically oriented and horizontally arranged, each plating tank having entrance and exit rollers and a submerged roller adjacent the bottom of the tank to guide the moving strip through each tank in a generally U-shaped path.

14. Apparatus as set forth in claim 13, in which spaced anode baskets are positioned in each plating tank, and having a conduit framework to direct plating solution through said anode baskets toward the moving strip.

15. Apparatus as set forth in claim 9, in which said plating tanks and at least some of the preplating and postplating tanks have a closed loop solution recirculation system.

16. Apparatus as set forth in claim 9, in which said heating stations provide infrared heaters with air knifes at the discharge end.

17. Apparatus as set forth in claim 16, in which at least one heating station is inclined on the slope of the moving strip.

* * * * *

UNITED STATES PATENT OFFICE

CERTIFICATE OF CORRECTION

PATENT NO. : 4,164,454

DATED : August 14, 1979

INVENTOR(S) : Michael A. Schober

It is certified that error appears in the above-identified patent and that said Letters Patent are hereby corrected as shown below:

Column 6, line 63, cancel "slite" and insert -- slits --.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*